US006349548B1

(12) United States Patent
Arana

(10) Patent No.: US 6,349,548 B1
(45) Date of Patent: Feb. 26, 2002

(54) APPARATUS AND PROCESS TO EXTRACT HEAT AND TO SOLIDIFY MOLTEN MATERIAL PARTICLES

(75) Inventor: David Arana, Los Lunas, NM (US)

(73) Assignee: Viviane Vasconcelos Vilela Ltd. (BR)

( * ) Notice: Subject to any disclaimer, the term of this patent is extended or adjusted under 35 U.S.C. 154(b) by 0 days.

(21) Appl. No.: 09/474,060

(22) Filed: Dec. 29, 1999

(30) Foreign Application Priority Data

Nov. 30, 1999 (BR) ..... 9905656

(51) Int. Cl.[7] ..... F25D 25/00
(52) U.S. Cl. ..... 62/64
(58) Field of Search ..... 62/62, 63, 64, 62/314, 373

(56) References Cited

U.S. PATENT DOCUMENTS

| | | | | |
|---|---|---|---|---|
| 4,461,636 A | | 7/1984 | Gagneraud et al. | |
| 4,914,922 A | * | 4/1990 | Talavera | 62/63 |
| 5,667,147 A | | 9/1997 | Edlinger | |
| 5,987,899 A | * | 11/1999 | Kiss | 62/64 |

FOREIGN PATENT DOCUMENTS

| | | |
|---|---|---|
| DE | 357 827 | 9/1922 |
| DE | 913 729 | 11/1953 |
| EP | 0 131 668 | 1/1985 |
| EP | 0 257 903 | 3/1988 |
| FR | 1 535 902 | 7/1968 |
| FR | 1 577 442 | 8/1969 |
| GB | 886 564 | 1/1962 |
| GB | 1 307 463 | 2/1973 |
| SU | 1 418 307 | 8/1988 |

OTHER PUBLICATIONS

Kojima et al; "Development of Air–Granulated Slag Production Process"; Nippon Steel Technical Report Overseas, JP, Nippon Steel Co., Toyo No. 17, Jun. 1, 1981; pp. 41–50.

Seirensho; Apparatus for Pelletizing Ferronickel Slag by Quenching with Water; Chemical Abstract, vol. 94, No. 16, Apr. 20, 1981.

Patent Abstracts of Japan; Molten Slag Processing Device; vol. 004, No. 050; Feb. 1980.

* cited by examiner

*Primary Examiner*—William Doerrler
*Assistant Examiner*—Malik N. Drake
(74) *Attorney, Agent, or Firm*—Nixon & Vanderhye PC

(57) ABSTRACT

The present invention relates to an apparatus and a process to extract heat and to solidify molten material particles. A flow of molten material is traversed by a high pressure dispersing/cooling flow to form particles of molten or semi-molten material. The particles impinge against a transporting device, which transport them to a collecting place. The transporting device is provided with a vibrator, which provides a vibrating movement to the transporting device to prevent the particles which are still cooling-off from being agglomerated again. A flow of a low pressure dispersing/cooling could be provided, which substantially transversely traverses said flow of particles of molten or semi-molten material which fall towards the transporting device, in order to enhance the dispersion and cooling-off effects of the particles. A hopper could be provided to collect the particles and to carry them to the transporting device. Cooling water pipes could be provided to eject a flow of cooling water onto the internal walls of the hopper and also onto the transporting device, which assist cooling of the dispersed particles.

53 Claims, 4 Drawing Sheets

APPARATUS AND PROCESS TO EXTRACT HEAT AND TO SOLIDIFY MOLTEN MATERIAL PARTICLES

FIELD OF THE INVENTION

This invention relates to a process and an apparatus to produce solid particles from a flow of molten material.

STATE OF THE ART

A number of processes are used to produce solid particles from a flow of molten material, which are known as granulating processes generally, granulating processes comprise pouring a flow of a molten material into a granulating chamber, where this downward flow of molten material is atomized by a dispersion member, causing this flow to disperse in a number of particles of molten material.

Said particles of molten material are quenched by contacting a cooling agent, usually water, in order to make a rapid cooling-off of the particles, thus forming the desired granules. A large volume of water is usually used to quench the dispersed particles of molten materials, in a relationship ranging from nine to twenty parts of water for one part of molten material.

Prior granulating processes produce granules of different sizes, which should be separated from the water after quenching, requiring the use of auxiliary separating equipment, therefore increasing costs.

Another problem with known processes of quenching by water is the risk of explosions. It is known that contact between extremely hot molten material particles and water results in violent reactions, which can jeopardize the operators and the facilities.

The quenching of the particles can occur inside of water reservoirs having an explosion-proof shield in order to preclude such risking conditions that might cause safety problems, therefore increasing the costs of the equipment.

In the recent years searches have been made to develop new processes which use fewer volumes of water rendering them safer for the operators and facilities.

U.S. Pat. No. 5,667,147 to Alfred Edlinger is an example of such approaches, which discloses a process and an apparatus for granulating molten materials. A jet of molten material is introduced by means of an injector into a mixing chamber, where a flow of compressed air and water is injected to promote dispersion of said jet of molten material within the chamber. The water injected into the chamber expands, rendering high kinetic energy to the dispersed particles. Particles of solidified material are injected into an area of a reduced cross section, located below the chamber.

After passing through such area of a reduced cross section the dispersed particles pass them through a diffuser, crossing a transverse flow of vapor coming from another diffuser, provoking more dispersion of the particles. Next, the particles impinge against a baffle plate, for attaining the desired size.

The fact of the dispersion of the particles is based on an expansion of water into a closed chamber is a drawback for the use of the apparatus and the process disclosed in U.S. Pat. No. 5,667,147, as it requires an accurate control of the volumes of injected water for the desired expansion to occur, which is not that simple to accomplish. This makes the operation critical and can eventually impair achievement of the goal, that is, the obtainment of solidified granules of molten material.

SUMMARY OF THE INVENTION

The apparatus for extracting heat and for solidifying molten material particles object of the present invention comprises at least one ejector of dispersing/cooling agent which provides a flow of a high pressure dispersing/cooling agent which substantially transversely traverses a downward flow of molten material so as to cause a dispersion effect which forms and cools particles of molten or semi-molten material. Said flow of high pressure dispersing/cooling agent comprises water and a high pressure gas.

It can be further provided with at least one low pressure gas duct providing a flow of a low pressure dispersing/cooling agent which substantially transversely traverses said flow of particles of molten or semi-molten material, in order to enhance the dispersion and cooling-off effects.

Said particles of molten or semi-molten material impinge against a transporting device, which transport them to a collecting place. The transporting device is provided with a vibrator, which provides a vibrating movement to the transporting device to prevent the particles which are still cooling-off from being agglomerated again.

The transporting device is also provided with a sloping device, which allows the inclination of the transporting device to be varied, in order to make possible the particles to remain a shorter or longer period on the transporting device so as to give the particles time enough for cooling-off.

A hopper can be further provided, which serves to collect the dispersed particles and to carry them onto the transporting device so as to prevent any particles from being launched outside the transporting device. The hopper is provided with a vibrator, which provides a vibrating movement to the hopper to prevent the particles which are still cooling-off from being agglomerated again.

Cooling water pipes could be provided to eject a flow of cooling water onto the internal walls of the hopper and also onto the transporting device, which assist cooling of the dispersed particles. This water cooling flow serves also to protect the walls of the hopper against heat.

The transporting device could be provided with multiple stages, and an air/water cooling pipe could be provided to eject a substantially transversely air/water cooling flow against the particles falling from a stage of the transporting device onto a following stage.

BRIEF DESCRIPTION OF THE DRAWINGS

The invention will be now described in more details in conjunction with the attached drawings, which for illustrative purposes only depict some embodiments of the invention.

DESCRIPTION OF PREFERRED EMBODIMENTS

Figure 1:
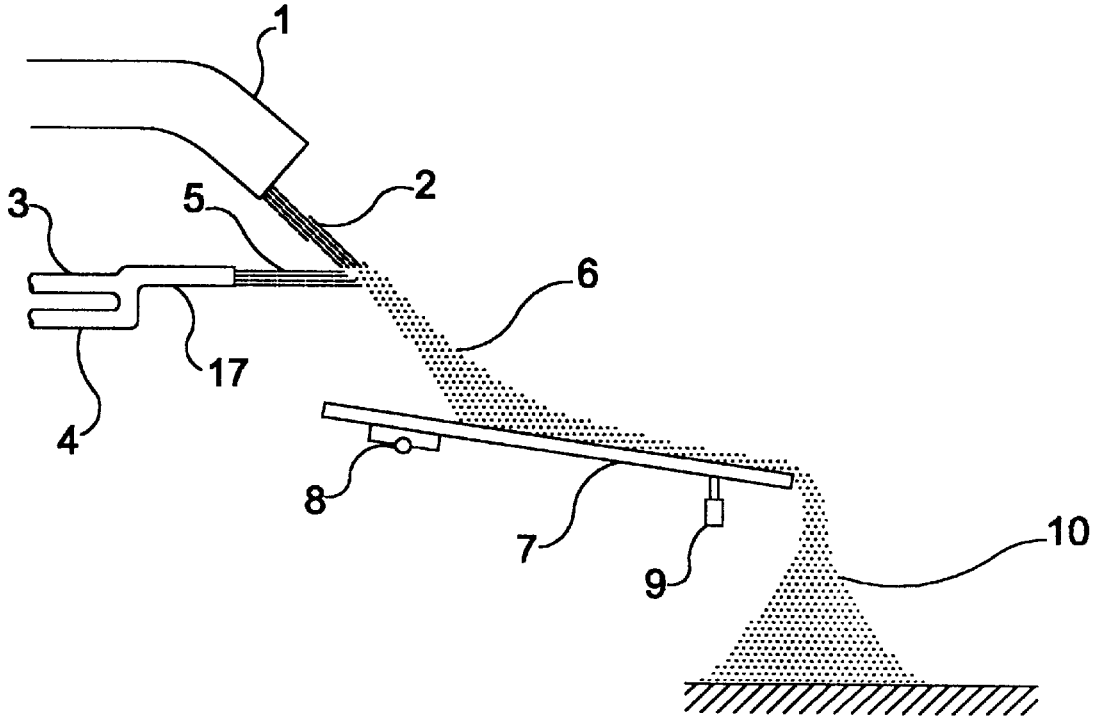
FIG. 1 schematically illustrates a first embodiment of an apparatus to extract heat and to solidify molten material particles according to the present invention.

FIG. 1 depicts a first embodiment of an apparatus object of the invention. A downward molten material flow 2 flows by gravity from a launder 1 and is traversed by a high pressure dispersing/cooling flow 5 coming from a dispersing/cooling agent ejector 17.

In the present embodiment the ejector 17 comprises a high pressure gas tube 4, which provides a flow of gas at a high pressure, e.g. air or nitrogen, the tube 4 being interconnected to an ejection water tube 3, which provide a flow of ejection water, therefore a high pressure dispersing/cooling flow 5 is provided at the outlet of the ejector 17.

The high pressure dispersing/cooling flow 5 substantially transversely traverses the downward molten material flow 2, in order to provoke dispersion of the latter in particles of molten or semi-molten material 6, provoking said particles 6 to cool-off at the same time.

The dispersed particles 6 of molten or semi-molten material next impinge onto a transporting device 7 which carry them to their collecting area. Some particles 6 would already be cooled-off when impinge against the transporting device 7, however, some particles 6 could be in a semi-molten state, making said particles 6 able to agglomerate again.

To preclude said particles 6 which are still in the semi-molten stage from being agglomerate again, the transporting device 7 is connected to a transporting device vibrator 8 which provides a vibrating motion to the transporting device 7, inhibiting said particles 6 which are still cooling-off from being agglomerated again.

The transporting device 7 is also provided with a sloping device 9, which allows the inclination of the transporting device 7 to be varied, in order to make possible the particles 6 to remain a shorter or longer period on the transporting device 7 so as to give the particles 7 time enough for cooling-off. Thus, when the particles 6 are dumped at its final collecting point, e.g. a pile 10, the particles 6 have already become hardened.

Figure 2:
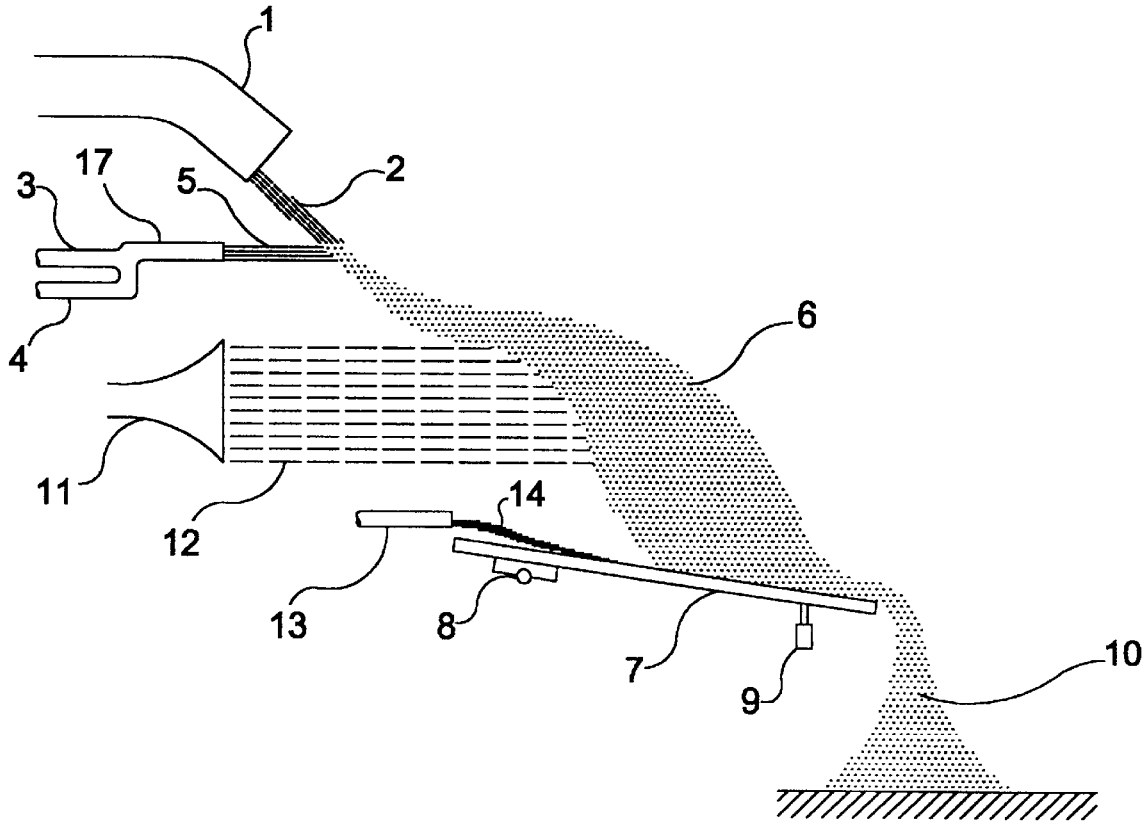
FIG. 2 is a view schematically showing the embodiment illustrated in FIG. 1 using a further low pressure flow to enhance the dispersion and cooling-off effects.

FIG. 2 depicts the apparatus of FIG. 1, where a low pressure gas duct 11 is used, the gas could be air or nitrogen, said duct 11 providing a low pressure dispersing/cooling flow 12 which substantially transversely traverses said particles 6, in a region located immediately below to the region where the particles 6 have been dispersed by said high pressure dispersing/cooling flow 5 traversing said downward molten material flow 2.

The contact between the particles 6 and the low pressure dispersing/cooling flow 12 enhances the cooling-off effect of the particles 6 and also cause said particles 6 to laterally displace when falling towards the transporting device 7. This cause the particles 6 to remain falling a little longer, favoring its cooling-off.

As can also be observed in FIG. 2 a cooling water pipe 13 provides a cooling water flow 14 onto the transporting device 7, in order to enhance the cooling-off effect of the particles 6 carried onto the transporting device 7, said cooling water flow 14 also protecting the transporting device 7 against the heat from the particles 6, which could damage the transporting device 7. The cooling water pipe 13 is optional, and more than one could be used, the use of said cooling water pipe 13 depends on the features of the molten material being poured at launder 2. In other words, this cooling water pipe 13 could be used whenever the particles 6 impinge onto the transporting device 7 at a relatively high temperature, which could require a cooling water flow 14 to cool-off the particles 6.

Figure 3:
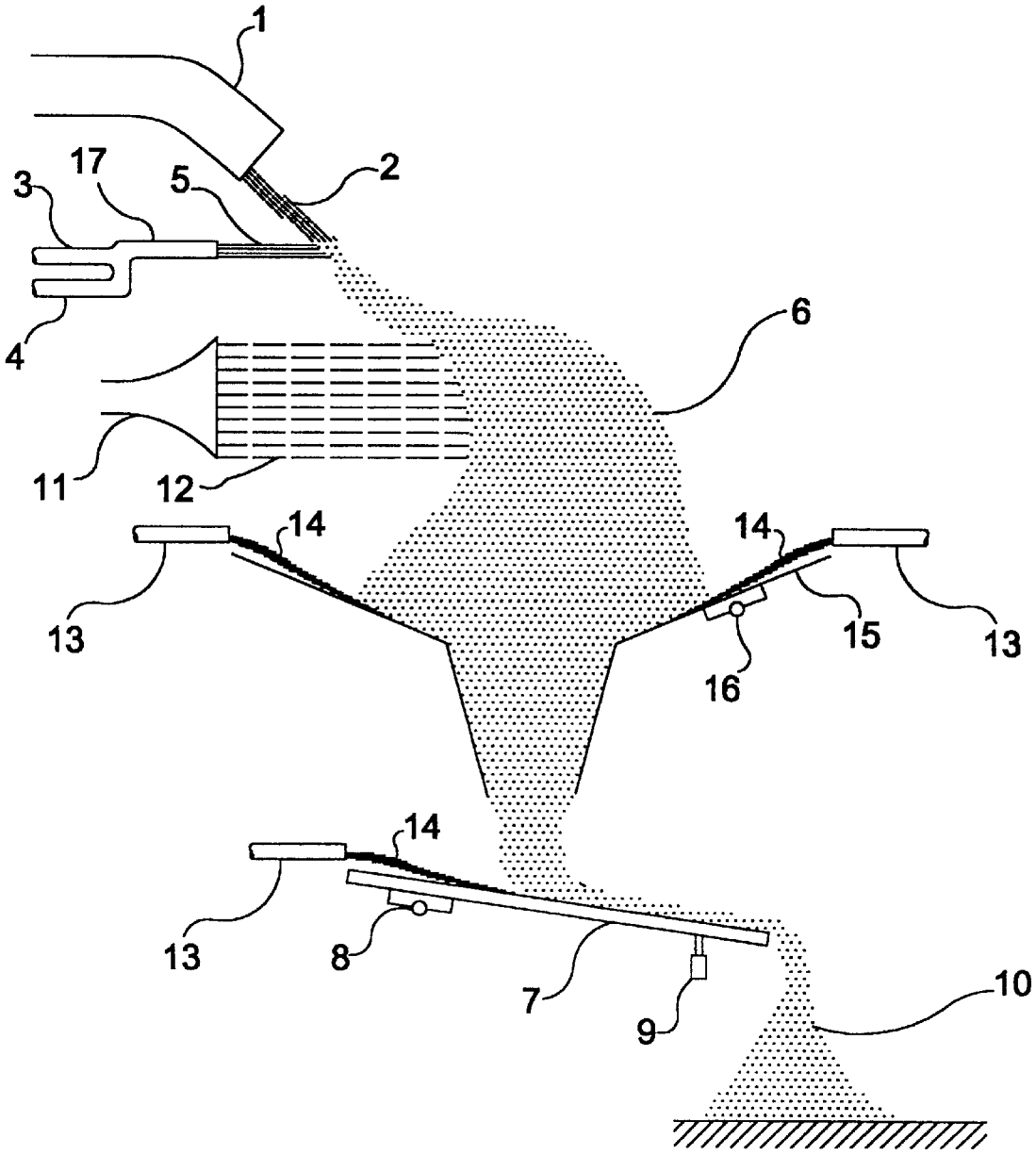
FIG. 3 schematically illustrates a second embodiment of an apparatus to extract heat and to solidify molten material particles according to the present invention.

FIG. 3 depicts a second embodiment of an apparatus to extract heat and to solidify molten material particles according to the present invention. This embodiment basically comprises the some parts previously described with regard to FIGS. 1 and 2, and for the sake of simplification it will not be described here again how occurs the dispersion of the molten material flow 2 into particles of molten or semi-molten material 6, as in this embodiment such dispersion occurs in the same way as previously described.

It should be pointed out that although the low pressure gas duct 11 is used in this embodiment and intended to provide a low pressure dispersing/cooling flow 12, said low pressure gas duct 11 could be omitted, depending on the features of the molten material flow which is to be dispersed into particles 6.

The apparatus shown in FIG. 3 differs from the previously shown apparatuses in comprising the use of a hopper 15, which serves to collect the dispersed particles 6, carrying them onto the transporting device 7 so as to prevent any particles from being launched outside the transporting device 7, as can be observed in the FIG.

The hopper 15 is provided with a hopper vibrator 16, which provides a vibrating movement to the hopper 15 to prevent the particles which are still cooling-off from being agglomerated again in its downward course within the hopper 15 towards the transporting device 7.

It should also be provided cooling water pipes 13 to eject a flow of cooling water pipe 14 onto the internal walls of the hopper 15, which assist cooling-off of the particles 6 in its downward course within the hopper 15 towards the transporting device 7, said flow 14 also protecting the hopper 15 against heat from the particles 6 which are still cooling-off, otherwise this heat could damage the hopper 15.

Figure 4:
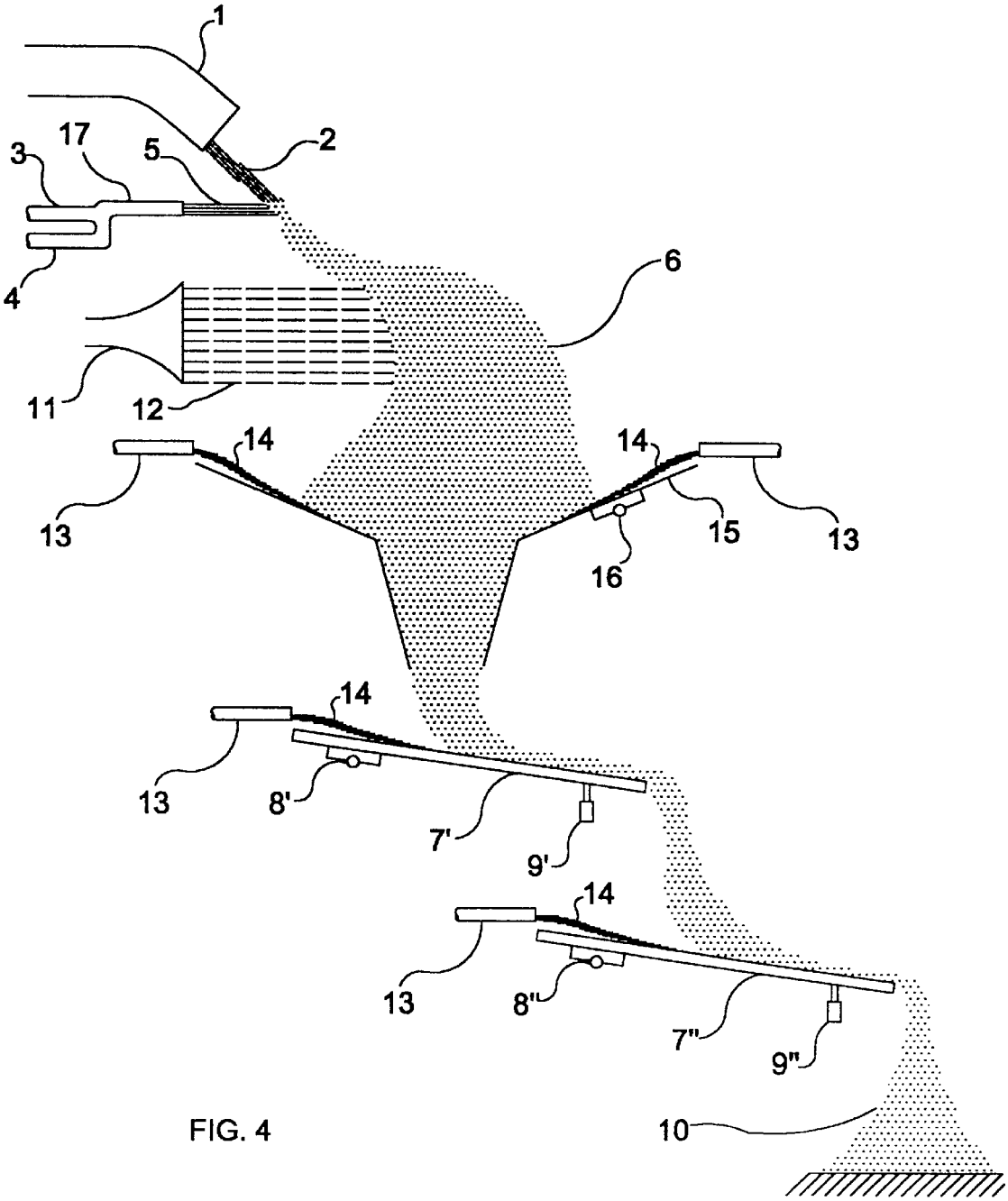
FIG. 4 is a view schematically showing the embodiment illustrated in FIG. 1 using a multiple stage transporting device.

FIG. 4 depicts the same apparatus shown in FIG. 3, in which a multiple-stage transporting device is used. In FIG. 4, for the purposes of exemplification only, the transporting device is provided with two stages. It can be observed a first transporter 7' which is provided with a transporting device vibrator 8' and a sloping device 9', and a second transporter 7" which is provided with a transporting device vibrator 8" and a sloping device 9".

The use of a multiple-stage transporting device favor the cooling-off of the particles 6, as the particles 6 passing from a stage onto other stage are accelerated by gravity and the contact between the particles and the air during this passage provides a further cooling-off effect. It must be pointed out that the number of stages of the transporting device is not limited to two, as depicted in the Figure, and any number of stages can be used if required.

It could be further used at least one air/water cooling pipe 18 to eject a substantially transversely air/water cooling flow 19 against the particles 6 falling from a stage of the transporting device towards a following stage, which enhances the cooling-off effect.

It should be mentioned that more than one dispersing/cooling agent ejector 17 could be used to provide a high pressure dispersing/cooling flow 5. Similarly, more than one low pressure gas duct 11 could be used to provide a low pressure dispersing/cooling flow 12.

It is known that a molten material flow 2 can vary over the time in volume, temperature and composition, and such variation can cause problems for the apparatus object of the invention to operate properly. For example, a change in the features of the molten material flow, e.g. an increase in the rate of flow, or a raise in the temperature can cause the particles 6 not to solidify when said particles arrived at their collecting point, which can lead the particles to agglomerate again.

The embodiments of the apparatus to extract heat and to solidify molten material particles according to the present invention hitherto described enable some measures to be taken to preclude the particles from agglomerating again. For example, the rate of flow of water into the ejection water tube 3 or into each cooling water pipe 13 can be increased; also the frequency of vibration of the transporting device vibrator 8 can be increased, or the inclination of the transporting device can be reduced by means of the sloping device 9. Such measures can be taken alone or in conjunction, rendering the apparatus to extract heat and to solidify molten material particles according to the present invention more flexible.

Although the apparatus to extract heat and to solidify molten material particles of the present invention has been described here according to preferred embodiments, those skilled in the art will readily understand that the invention is not limited to the described embodiments, and modifications and substitutions may be made without thereby departing from the spirit and the scope of the invention, which is limited only by the content of the appended claims.

SEQUENCE LISTING PARTS

1 launder
2 molten material flow
3 ejection water tube
4 high pressure gas tube
5 high pressure dispersing/cooling flow
6 particles
7 transporting device
8 transporting device vibrator
9 sloping device
10 pile
11 low pressure gas duct
12 low pressure dispersing/cooling flow
13 cooling water pipe
14 cooling water flow
15 hopper
16 hopper vibrator
17 dispersing/cooling agent ejector
18 air/water cooling pipe
19 air/water cooling flow

What is claimed is:

1. An apparatus to extract heat and to solidify molten material particles from a molten material flow which issues out of a launder, said apparatus comprising:

a dispersing/cooling agent ejector providing a high pressure dispersing/cooling flow which substantially transversely traverses said molten material flow;

a transporting device which collects said falling dispersed particles of molten or semi-molten material and transport them to a final destination;

a transporting device vibrator connected to said transporting device;

a sloping device connected to the transporting device.

2. An apparatus according to claim 1, wherein said high pressure dispersing/cooling flow provided by said ejector comprises a high pressure gas mixed with water.

3. An apparatus according to claim 2, wherein said high pressure gas of said high pressure dispersing/cooling flow provided by said ejector is one between nitrogen and air.

4. An apparatus according to claim 1, wherein it further comprises providing a low pressure gas duct providing a low pressure dispersing/cooling flow which substantially transversely traverses said particles in a region located immediately below the region where said particles have been created by the dispersion caused by said high pressure dispersing/cooling flow acting throughout the downward molten material flow.

5. An apparatus according to claim 4, wherein it is provided a hopper to collect said falling particles, carrying them onto said transporting device.

6. An apparatus according to claim 5, wherein at least one cooling water pipe is provided to eject a cooling water flow onto said transporting device.

7. An apparatus according to claim 6, wherein said hopper is provided with a hopper vibrator.

8. An apparatus according to claim 7, wherein at least one cooling water pipe is provided to eject a cooling water flow onto the internal walls of said hopper.

9. An apparatus according to claim 8, wherein said high pressure dispersing/cooling flow provided by said ejector comprises a high pressure gas mixed with water.

10. An apparatus according to claim 9, wherein said high pressure gas of said high pressure dispersing/cooling flow provided by said ejector is one between nitrogen and air.

11. An apparatus according to claim 8, wherein said transporting device is a multiple-stage transporting device.

12. An apparatus according to claim 11, wherein at least one air/water cooling pipe is provided to eject an air/water cooling flow which substantially transversely traverses said particles falling from a stage of the transporting device towards a following stage.

13. An apparatus according to claim 12, wherein said high pressure dispersing/cooling flow provided by said ejector comprises a high pressure gas mixed with water.

14. An apparatus according to claim 13, wherein said high pressure gas of said high pressure dispersing/cooling flow provided by said ejector is one between nitrogen and air.

15. An apparatus according to claim 1, wherein said transporting device is a multiple-stage transporting device.

16. An apparatus according to claim 15, wherein at least one cooling water pipe is provided to eject a cooling water flow onto said transporting device.

17. An apparatus according to claim 16, wherein at least one air/water cooling pipe is provided to eject an air/water cooling flow which substantially transversely traverses said particles falling from a stage of the transporting device towards a following stage.

18. An apparatus according to claim 15, wherein it further comprises providing a low pressure gas duct providing a low pressure dispersing/cooling flow which substantially transversely traverses said particles in a region located immediately below the region where said particles have been created by the dispersion caused by said high pressure dispersing/cooling flow acting throughout the downward molten material flow.

19. An apparatus according to claim 18, wherein at least one cooling water pipe is provided to eject a cooling water flow onto said transporting device.

20. An apparatus according to claim 19, wherein at least one air/water cooling pipe is provided to eject an air/water cooling flow which substantially transversely traverses said particles falling from a stage of the transporting device towards a following stage.

21. An apparatus according to claim 20, wherein said high pressure dispersing/cooling flow provided by said ejector comprises a high pressure gas mixed with water.

22. An apparatus according to claim 21, wherein said high pressure gas of said high pressure dispersing/cooling flow provided by said ejector is one between nitrogen and air.

23. A process to extract heat and to solidify molten material particles from a molten material flow which issues out of a launder, said process comprising the steps of:

providing a high pressure dispersing/cooling flow which substantially transversely traverses said molten material flow to disperse it into particles of molten or semi-molten material;

collecting said falling dispersed particles of molten or semi-molten material in a transporting device, which is provided with a transporting device vibrator, said transporting device being also provided with a sloping device for varying the inclination of said sloping device.

24. A process according to claim 23, wherein said high pressure dispersing/cooling flow provided by said ejector comprises a high pressure gas mixed with water.

25. A process according to claim 24, wherein said high pressure gas of said high pressure dispersing/cooling flow is one between nitrogen and air.

26. A process according to claim 23, wherein it further comprises providing a low pressure dispersing/cooling flow which substantially transversely traverses said particles in a region located immediately below the region where said particles have been created by the dispersion caused by said high pressure dispersing/cooling flow acting throughout said downward molten material flow.

27. A process according to claim 26, wherein it is further provided a hopper intended to collect said falling particles carrying them onto said transporting device.

28. A process according to claim 27, wherein at least one cooling water pipe is provided, which ejects a cooling water flow onto said transporting device.

29. A process according to claim 28, wherein said hopper is provided with a hopper vibrator.

30. A process according to claim 29, wherein at least one cooling water pipe is provided to eject a cooling water flow onto an internal walls of said hopper.

31. A process according to claim 30, wherein said high pressure dispersing/cooling flow provided by said ejector comprises a high pressure gas mixed with water.

32. A process according to claim 31, wherein said high pressure gas of said high pressure dispersing/cooling flow is one between nitrogen and air.

33. A process according to claim 32, wherein the rate of flow of water of each water ejection/cooling flow is increased when it is noticed that said particles are agglomerating again.

34. A process according to claim 33, wherein the frequence of vibration of each vibrator is increased when it is noticed said the particles are agglomerating again.

35. A process according to claim 34, wherein the inclination of said transporting device is reduced, by means of its respective sloping device, when it is noticed that the particles are agglomerating again.

36. A process according to claim 30, wherein said transporting device is a multiple-stage transporting device.

37. A process according to claim 36, wherein at least one air/water cooling pipe is provided to provide an air/water cooling flow which substantially transversely traverses said particles falling from a stage of said transporting device towards a following stage.

38. A process according to claim 37, wherein said high pressure dispersing/cooling flow provided by said ejector comprises a high pressure gas mixed with water.

39. A process according to claim 38, wherein said high pressure gas of said high pressure dispersing/cooling flow is one between nitrogen and air.

40. A process according to claim 39, wherein the rate of flow of water of each water ejection/cooling flow is increased when it is noticed that said particles are agglomerating again.

41. A process according to claim 40, wherein the frequence of vibration of each vibrator is increased when it is noticed said the particles are agglomerating again.

42. A process according to claim 41, wherein the inclination of each transporting device is reduced, by means of its respective sloping device, when it is noticed that the particles are agglomerating again.

43. A process according to claim 23, wherein said transporting device is a multiple-stage transporting device.

44. A process according to claim 43, wherein at least one cooling water pipe is provided, which ejects a cooling water flow onto said transporting device.

45. A process according to claim 44, wherein at least one air/water cooling pipe is provided to provide an air/water cooling flow which substantially transversely traverses said particles falling from a stage of said transporting device towards a following stage.

46. A process according to claim 43, wherein it further comprises providing a low pressure dispersing/cooling flow which substantially transversely traverses said particles in a region located immediately below the region where said particles have been created by the dispersion caused by said high pressure dispersing/cooling flow acting throughout said downward molten material flow.

47. A process according to claim 46, wherein at least one cooling water pipe is provided, which ejects a cooling water flow onto said transporting device.

48. A process according to claim 47, wherein at least one air/water cooling pipe is provided to provide an air/water cooling flow which substantially transversely traverses said particles failing from a stage of said transporting device towards a following stage.

49. A process according to claim 48, wherein said high pressure dispersing/cooling flow provided by said ejector comprises a high pressure gas mixed with water.

50. A process according to claim 49, wherein said high pressure gas of said high pressure dispersing/cooling flow is one between nitrogen and air.

51. A process according to claim 50, wherein the rate of flow of water of each water ejection/cooling flow is increased when it is noticed that said particles are agglomerating again.

52. A process according to claim 51, wherein the frequence of vibration of each vibrator is increased when it is noticed said the particles are agglomerating again.

53. A process according to claim 52, wherein the inclination of each transporting device is reduced, by means of its respective sloping device, when it is noticed that the particles are agglomerating again.

* * * * *